US006978556B1

(12) United States Patent
Cornelious

(10) Patent No.: US 6,978,556 B1
(45) Date of Patent: Dec. 27, 2005

(54) COMBINATION WASHING MACHINE AND DRYER

(76) Inventor: Ephelius Cornelious, 2633 Tredway Dr., Macon, GA (US) 31211

( * ) Notice: Subject to any disclaimer, the term of this patent is extended or adjusted under 35 U.S.C. 154(b) by 0 days.

(21) Appl. No.: 11/039,408

(22) Filed: Jan. 19, 2005

(51) Int. Cl.[7] ..... F26B 11/02
(52) U.S. Cl. ..... 34/596; 34/527; 34/60; 34/603; D32/5
(58) Field of Search ..... 34/524, 526, 527, 34/573, 60, 595, 596, 603, 139, 236; D32/5; 68/3 R, 13 R, 19.2

(56) References Cited

U.S. PATENT DOCUMENTS

D172,386 S 6/1954 Geldhof ..... D49/1
4,531,387 A 7/1985 Cotton ..... 68/3
D367,135 S 2/1996 Jackovin ..... D32/5
6,671,978 B1 * 1/2004 McGowan et al. ..... 34/596

* cited by examiner

*Primary Examiner*—Jiping Lu

(74) *Attorney, Agent, or Firm*—Goldstein Law Offices PC.

(57) ABSTRACT

A combination washing machine and dryer having a trap door interposed between a washing machine and a fabric dryer. After the washing machine has finished washing the clothes contained therein, the trap door automatically opens to allow the wet clothing to fall into the fabric dryer, thereby obviating the need for the user to interrupt whatever he/she is doing in order to remove the wet clothing from the washing machine and to transfer the clothing to the fabric dryer for subsequent drying.

7 Claims, 1 Drawing Sheet

COMBINATION WASHING MACHINE AND DRYER

BACKGROUND OF THE INVENTION

1. Field of the Invention

The invention generally relates to a combination washing machine and dryer, and in particular relates to a combination washing machine and dryer having a trap door interposed between a washing machine and a fabric dryer, wherein after the washing machine has finished washing the clothes contained therein, the trap door opens to allow the wet clothing to fall into the fabric dryer for subsequent drying.

2. Description of the Related Art

Washing machines are used by scores of millions of housewives and stay-at-home husbands for automatically washing clothes. After washing clothes within a washing machine, a user must remove the wet clothes therefrom, and either hang the clothes upon a clothesline to dry or place the clothes within an electric dryer which automatically warms and dries the clothes. Consequently, "doing laundry" is a two-step process that requires the user to interrupt whatever he/she is doing in order to remove wet clothing from a washing machine and transfer the clothing to a clothesline or a fabric dryer for subsequent drying. Accordingly, there is a need for a combination washing machine and dryer having a trap door interposed between a washing machine and a fabric dryer, wherein after the washing machine has finished washing the clothes contained therein, the trap door opens to allow the wet clothing to fall into the fabric dryer, thereby obviating the need for the user to interrupt whatever he/she is doing in order to remove wet clothing from the washing machine and transfer the clothing to the fabric dryer for subsequent drying.

A variety of combination washing machine and dryers have been devised. For example, U.S. Pat. No. 4,531,387 to Cotton appears to show a combination washing machine and dryer comprising a fabric dryer mounted on an appliance support stand above an automatic washing machine. Additionally, U.S Pat. No. D172,386 to Geldhof and U.S. Pat. No. D367,135 to Jackovin each appear to show an ornamental design for a combination washing machine and dryer.

While these devices may be suitable for the particular purpose employed, or for general use, they would not be as suitable for the purposes of the present invention as disclosed hereafter.

SUMMARY OF THE INVENTION

It is a primary object of the invention to provide a combination washing machine and dryer which obviates the need for a user to interrupt whatever he/she is doing in order to remove wet clothing from a washing machine and to transfer the clothing to a fabric dryer for subsequent drying. Accordingly, the combination washing machine and dryer comprises a fabric dryer having a washing machine supported thereupon, and has a trap door interposed between the washing machine and the fabric dryer. After the washing machine has finished washing the clothes contained therein, the trap door automatically opens to allow the wet clothing to fall into the fabric dryer, thereby obviating the need for the user to interrupt whatever he/she is doing in order to remove wet clothing from the washing machine and to transfer the clothing to the fabric dryer for subsequent drying.

Further objects of the invention will become apparent in the detailed description of the invention that follows.

The invention is a combination washing machine and dryer having a trap door interposed between a washing machine and a fabric dryer. After the washing machine has finished washing the clothes contained therein, the trap door automatically opens to allow the wet clothing to fall into the fabric dryer, thereby obviating the need for the user to interrupt whatever he/she is doing in order to remove the wet clothing from the washing machine and to transfer the clothing to the fabric dryer for subsequent drying.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
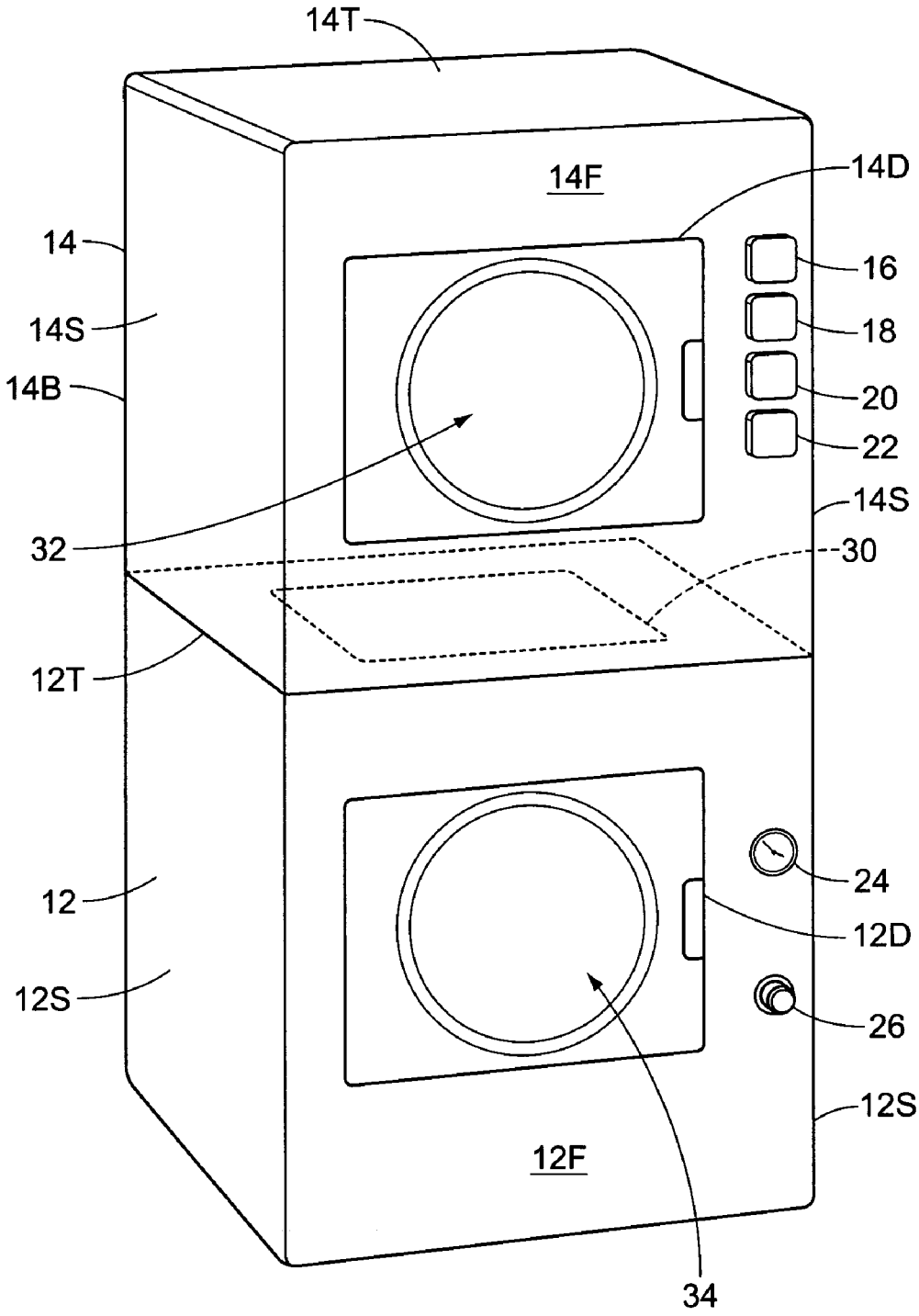
FIG. 1 is a perspective view of a combination washing machine and dryer, wherein an arrow indicates the direction in which wet clothes fall from a washing machine into a fabric dryer through a trap door interposed therebetween, after the washing machine has finished washing the clothes contained therein.

FIG. 1 illustrates a combination washing machine and dryer 10, comprising a substantially rectangular fabric dryer 12 having a substantially rectangular washing machine 14 supported thereupon. The fabric dryer 12 has a top 12T, a bottom 12B, a front 12F, a rear 12R, and two opposing sides 12S. In like manner, the washing machine 14 has a top 14T, a bottom 14B, a front 14F, a rear 14R, and two opposing sides 14S. The bottom 14B of the washing machine 14 is substantially supported upon the top 12T of the fabric dryer 12. The washing machine 14 contains a substantially hollow washing chamber 32 wherein a user places clothes prior to activating the washing machine 14. The fabric dryer 12 contains a substantially hollow drying chamber 34 wherein the clothes which have been washed within the washing chamber 32 are subsequently warmed and dried. The washing chamber 32 is selectively filled with water and detergent and selectively spins, thereby facilitating the washing of the clothes. The drying chamber 34 also selectively spins, thereby facilitating the drying of the clothes. The washing chamber 32 is selectively separated from the drying chamber 34 by a substantially horizontally situated trap door 30 interposed between the washing machine 14 and the dryer 12. The washing machine 14 and the trap door 30 are each in electrical communication with a washing machine timer 20. The timer 20 is activated upon activation of the washing machine 14. When the washing machine 14 has finished washing the clothes contained therein, the timer 20 automatically deactivates the washing machine 14 and simultaneously causes the trap door 30 to open, thereby allowing the wet clothes contained therein to fall into the drying chamber 34. Gravity causes the wet clothes to fall from the washing chamber 32 into the drying chamber 34. In an alternate embodiment, the trap door 30 opens just before the washing chamber 32 has stopped spinning, so that the spinning of the washing chamber 32 will cause the wet clothing to dislodge therefrom, so that the clothes may easily fall into the drying chamber 34.

Both the washing machine 14 and the fabric dryer 12 have a front access door, 14D and 12D, respectively, which are positioned upon the front, 14F and 12F, respectively, of the washing machine 14 and the fabric dryer 12. A user selectively opens the front access door 14D of the washing machine 14 in order to fill the washing chamber 32 with clothes. The user selectively opens the front access door 12D of the dryer 12 in order to remove the clothes from the drying chamber 34 after they have been thoroughly dried.

The washing machine 14 has an activation button 16, an operational cycle knob 18, the timer 20, and a temperature set knob 22. The activation button 16 is used to selectively activate the washing machine 14. The operational cycle knob 18 enables the user to choose from a variety of operational cycles, including a permanent press wash cycle for clothes that do not require ironing, a gentle wash cycle for delicate items such as sweaters and baby clothes, and a regular wash cycle for all other types of clothes. The temperature set knob 22 enables the user to choose the water temperature at which washing of the clothes will be effected.

The fabric dryer 12 has a dryer timer knob 24 and a dryer temperature set knob 26. The dryer timer knob 24 is set by the user to a particular time interval after which the dryer 12 will automatically be deactivated. The temperature set knob 26 is set by the user to a temperature range; either low, medium, or high; which is most suitable for the particular items of clothing which are to be dried within the drying chamber 34.

In use, prior to loading the washing chamber 32 with clothes, a user utilizes the operational cycle knob 18 to choose among the variety of available operational cycles. In particular, the user chooses the permanent press wash cycle for clothes that do not require ironing, the gentle wash cycle for delicate items such as sweaters and baby clothes, and the regular wash cycle for all other types of clothes. The user utilizes the temperature set knob 22 of the washing machine 14 to choose the water temperature at which washing of the clothes will be effected. The user sets the dryer timer knob 24 to a particular time interval after which the dryer 12 will automatically be deactivated. The user sets the temperature set knob 26 of the dryer 12 to the temperature range; either low, medium, or high; which is most suitable for the particular items of clothing which are to be dried within the drying chamber 34. The user opens the washing chamber door 14D and loads the washing chamber 32 with the clothes that are to be washed. The user selectively activates the washing machine 14 by depressing the activation button 16, thereby activating the washing machine timer 20. After the washing machine 12 has finished washing the clothes contained therein, in accordance with the operational cycle as chosen with the operational cycle knob 18, the timer 20 automatically deactivates the washing machine 14 and simultaneously causes the trap door 30 to open, thereby allowing the wet clothes contained therein to fall into the drying chamber 34 for subsequent drying, thereby obviating the need for the user to interrupt whatever he/she is doing in order to remove wet clothing from the washing machine 14 and to transfer the clothing to the fabric dryer 12. After the particular time interval at which the dryer 12 is deactivated has elapsed, as chosen by the dryer timer knob 24, the dryer 12 is automatically deactivated. The user opens the drying chamber door 12D and removes the dried clothes from the drying chamber 34.

In conclusion, herein is presented a combination washing machine and dryer having a trap door interposed between a washing machine and a fabric dryer, wherein after the washing machine has finished washing clothes contained therein, the trap door opens to allow wet clothing to fall into the fabric dryer wherein they are subsequent dried. The invention is illustrated by example in the drawing figures, and throughout the written description. It should be understood that numerous variations are possible, while adhering to the inventive concept. Such variations are contemplated as being a part of the present invention.

What is claimed is:

1. A combination washing machine and dryer that obviates the need for a user to remove wet clothing from a washing machine and to transfer the clothing to a fabric dryer, said combination washing machine and dryer comprising:

a fabric dryer having:

a top, a bottom, a front, a rear, and two opposing sides;

a substantially hollow drying chamber for drying wet clothes; and an access door which is selectively opened in order to remove the clothes from the drying chamber after they have been thoroughly dried; and a washing machine having:

a top, a bottom, a front, a rear, and two opposing sides, wherein the bottom of the washing machine is substantially supported upon the top of the fabric dryer;

a substantially hollow washing chamber into which clothes are placed prior to activating the washing machine;

a trap door which selectively separates the washing chamber from the drying chamber;

an access door which is selectively opened in order to fill the washing chamber with clothes;

an activation button for selectively activating the washing machine; and a washing machine timer in electrical communication with both the washing machine and the trap door, wherein the timer is activated upon activation of the washing machine; and wherein when the washing machine has finished washing the clothes contained therein, the timer automatically deactivates the washing machine and simultaneously causes the trap door to open, thereby allowing the wet clothes contained therein to fall into the drying chamber of the fabric dryer where they are subsequently dried.

2. The combination washing machine and dryer as recited in claim 1, wherein the fabric dryer further has a dryer timer knob which is set by the user to a particular time interval after which the dryer will automatically be deactivated.

3. The combination washing machine and dryer as recited in claim 2, wherein the fabric dryer further has a dryer temperature set knob for enabling the user to set a temperature range; either low, medium, or high; which is most suitable for the particular items of clothing which are to be dried within the drying chamber.

4. The combination washing machine and dryer as recited in claim 3, wherein the washing machine further has an operational cycle knob for enabling the user to choose from a variety of operational cycles, including a permanent press wash cycle, a gentle wash cycle, and a regular wash cycle.

5. The combination washing machine and dryer as recited in claim 4, wherein the washing machine further has a temperature set knob for enabling the user to choose the water temperature at which washing of the clothes will be effected.

6. A method for obviating the need for a user to remove wet clothing from a washing machine and to transfer the clothing to a fabric dryer for subsequent drying, said method utilizing a combination washing machine and dryer having a fabric dryer having a top, a drying chamber for drying wet clothes, and an access door, said combination washing machine and dryer further having a washing machine supported upon the top of the fabric dryer, a washing chamber for washing clothes, a trap door which selectively separates the washing chamber from the drying chamber, an access door, an activation button for selectively activating the washing machine, and a washing machine timer in electrical communication with both the washing machine and the trap door, said washing machine timer for setting a time interval, wherein the timer is activated upon activation of the washing machine, said method comprising the steps of:

opening the washing chamber door and loading the washing chamber with the clothes that are to be washed;

activating the washing machine by depressing the activation button, and thereby activating the washing machine timer;

washing the clothes within the washing machine;

automatically deactivating the washing machine with the timer after the time interval has passed, and simultaneously causing the trap door to open, thereby allowing the wet clothes contained within the washing chamber to fall into the drying chamber for subsequent drying, and thereby obviating the need for the user to remove wet clothing from the washing machine and to transfer the clothing to the fabric dryer; and opening the drying chamber door and removing the dried clothes from the drying chamber.

7. The method as recited in claim 6, wherein the combination washing machine and dryer further has an operational cycle knob for choosing among a variety of available operational cycles, wherein the step of opening the washing chamber door and loading the washing chamber is preceded by the step of utilizing the operational cycle knob to choose among the variety of available operational cycles.

* * * * *